United States Patent [19]

Crouch

[11] Patent Number: 4,676,506

[45] Date of Patent: Jun. 30, 1987

[54] ODDS INDICATOR FOR POKER MACHINES

[75] Inventor: Philip C. Crouch, Vaucluse, Australia

[73] Assignee: Ainsworth Nominees Pty, Limited, Rosebery, Australia

[21] Appl. No.: 805,287

[22] Filed: Dec. 5, 1985

[30] Foreign Application Priority Data

Feb. 14, 1985 [AU] Australia ..... PG9280

[51] Int. Cl.[4] ..... A63F 5/04

[52] U.S. Cl. ..... 273/143 R

[58] Field of Search ..... A63F/5/04; 273/143 R, 273/143 B, 143 C, 143 D, 143 E, 138 A

[56] References Cited

U.S. PATENT DOCUMENTS 2,133,165 10/1938 Eisenberg et al. ..... 273/86 F 3,815,912 6/1974 Wichinsky et al. ..... 273/86 F

FOREIGN PATENT DOCUMENTS 2054232 2/1981 United Kingdom ..... 273/143 R 2103856 2/1983 United Kingdom ..... 273/143 R

*Primary Examiner*—Anton O. Oechsle

*Attorney, Agent, or Firm*—Browdy and Neimark

[57] ABSTRACT

An odds indicator for a poker machine consisting of a cylinder having on its external surface a number of axially distributed bands each bearing on its circumference indicia each indicating a ratio by which a prize offered for a prize winning combination is to be multiplied, one ratio of the ratios displayed on each band being visible through a viewing window in the front of the machine in a column one above the other or side by side, there being displayed on the front of the machine a list of prize winning combinations opposite each of which, or a number which, one of the visible ratios appears and an indication of the prize to be delivered on achieving that particular combination when any one of the ratios displayed on a band is visible, the cylinder being rotatable so as to enable the visible ratios seen through the viewing window to be changed.

3 Claims, 2 Drawing Figures

| | | | | | | | | | | | | | | |
|---|---|---|---|---|---|---|---|---|---|---|---|---|---|---|
| | A A A A A | | | | | 5000 | | | Jo Jo Jo Jo Jo | | | | | 10000 |
| | 10 10 10 10 10 | | | | | 500 | | | K K K K K | | | | | 2000 |
| | 9 9 9 9 9 | | | | | 500 | | | Q Q Q Q Q | | | | | 1500 |
| | 7 7 7 7 7 | | | | | 500 | | | J J J J J | | | | | 1000 |
| ON ANY LIT LINE | EVEN | 2·1 | 3·1 | 4·1 | 5·1 | 10·1 | ODDS INDICATOR | 10·1 | 5·1 | 4·1 | 3·1 | 2·1 | EVEN | ON ANY LIT LINE |
| Jo Jo Jo Jo - | 1000 | 2000 | 3000 | 4000 | 5000 | 10000 | 5·1 | 10000 | 5000 | 4000 | 3000 | 2000 | 1000 | - Jo Jo Jo Jo |
| Jo Jo Jo - - | 200 | 400 | 600 | 800 | 1000 | 2000 | | 2000 | 1000 | 800 | 600 | 400 | 200 | - - Jo Jo Jo |
| A A A A - | 500 | 1000 | 1500 | 2000 | 2500 | 5000 | EVEN | 5000 | 2500 | 2000 | 1500 | 1000 | 500 | - A A A A |
| A A A - - | 100 | 200 | 300 | 400 | 500 | 1000 | | 1000 | 500 | 400 | 300 | 200 | 100 | - - A A A |
| K K K K - | 200 | 400 | 600 | 800 | 1000 | 2000 | 2·1 | 2000 | 1000 | 800 | 600 | 400 | 200 | - K K K K |
| K K K - - | 20 | 40 | 60 | 80 | 100 | 200 | | 200 | 100 | 80 | 60 | 40 | 20 | - - K K K |
| Q Q Q Q - | 150 | 300 | 450 | 600 | 750 | 1500 | 10·1 | 1500 | 750 | 600 | 450 | 300 | 150 | - Q Q Q Q |
| Q Q Q - - | 15 | 30 | 45 | 60 | 75 | 150 | | 150 | 75 | 60 | 45 | 30 | 15 | - - Q Q Q |
| J J J J - | 100 | 200 | 300 | 400 | 500 | 1000 | EVEN | 1000 | 500 | 400 | 300 | 200 | 100 | - J J J J |
| J J J - - | 10 | 20 | 30 | 40 | 50 | 100 | | 100 | 50 | 40 | 30 | 20 | 10 | - - J J J |
| 10 10 10 10 - | 50 | 100 | 150 | 200 | 250 | 500 | 3·1 | 500 | 250 | 200 | 150 | 100 | 50 | - 10 10 10 10 |
| 10 10 10 - - | 10 | 20 | 30 | 40 | 50 | 100 | | 100 | 50 | 40 | 30 | 20 | 10 | - - 10 10 10 |
| 9 9 9 9 - | 50 | 100 | 150 | 200 | 250 | 500 | EVEN | 500 | 250 | 200 | 150 | 100 | 50 | - 9 9 9 9 |
| 9 9 9 - - | 10 | 20 | 30 | 40 | 50 | 100 | | 100 | 50 | 40 | 30 | 20 | 10 | - - 9 9 9 |
| 7 7 7 7 - | 50 | 100 | 150 | 200 | 250 | 500 | 2·1 | 500 | 250 | 200 | 150 | 100 | 50 | - 7 7 7 7 |
| 7 7 7 - - | 10 | 20 | 30 | 40 | 50 | 100 | | 100 | 50 | 40 | 30 | 20 | 10 | - - 7 7 7 |

16

16

9 - - - - 2 10 - - - - 2 9 9 - - - 5 10 10 - - - 5

- - - - 9 2 - - - - 10 2 - - - 9 9 5 - - - 10 10 5

FIG. 2

ODDS INDICATOR FOR POKER MACHINES

FIELD OF THE INVENTION

The present invention relates to an odds indicator for amusement machines of the kind known variously as poker machines, slot machines or fruit machines (hereinafter referred to as poker machines), that is to say, to a device for indicating the odds for achieving any particular prize winning combination and thus the magnitude of the prize to be won by achieving that particular combination for a particular handle pull or game.

BACKGROUND OF THE INVENTION

As is well known, poker machines consist of a number of reels or drums rotating about a horizontal axis, there being arranged around the circumference of each drum a plurality of symbols which may be playing cards, fruit or any other arbitrarily chosen symbols, at least one symbol from each drum being visible simultaneously behind a viewing window in the front of the machine. Prizes are won by causing particular combinations of symbols to appear in the window. For a machine using playing cards as symbols, for example, and having four drums, the appearance of four aces, that is an ace on each drum, in the viewing window will normally give rise to a substantial prize. On the other hand the appearance of, for example four nines will usually give rise to a lesser prize, on the basis that nines occur with greater frequency on the drums than aces.

On an ordinary machine the appearance of, for example four aces would give rise to a predetermined prize. It has however been proposed, as a means of introducing a certain amount of variety into the playing of the machine, to have, in addition to the normal drums or reels, an additional drum which instead of displaying symbols shows ratios such as 1:1 (evens), 2:1, 3:1 etc. The significance of these is that if a paying combination is exhibited, alongside it will appear a particular ratio and the actual prize gained will be an amount displayed on the front of the machine multiplied by the ratio displayed.

The present invention provides improvement on this arrangement in that it provides a construction in which not only is the ratio displayed directly adjacent to a table of prizes to enable a player to consult a column of figures and thus obtain a direct indication of the prize that he wins, without the need for mental arithmetic, but also enables different odds to be applied to different combinations. In known machines with variable odds the same odds are applied to all prize winning combinations.

The present invention consists in an odds indicator for a poker machine consisting of a cylinder having on its external surface a plurality of axially distributed bands each band bearing on its circumference a plurality of circumferentially spaced indicia, each indicating a ratio by which a prize offered for a prize winning combination is to be multiplied, one ratio of the ratios displayed on each band being visible through a viewing window in the front of the machine in a column one above the other or side by side, there being displayed on the front of the machine a list of prize winning combinations opposite each of which, or a number of which, one of the visible ratios appears and an indication of the prize to be delivered on achieving that particular combination when any of the ratios displayed on a band is visible, means being provided for rotation of the cylinder to enable the visible ratios to be changed.

DESCRIPTION OF THE DRAWINGS

In order that the nature of the invention may be better understood a preferred form of the invention is hereinafter described by way of example with reference to the accompanying drawings in which:-

FIG. 2 is a view of a display window on the front of a machine with a table of prizes adjacent to it.

FIG. 1 shows a vertical shaft 10 having affixed to it a plurality of drums 11, the drums being fastened to the shaft so that all rotate in unison. The shaft 10 is driven by a stepper motor 12.

Figure 1:
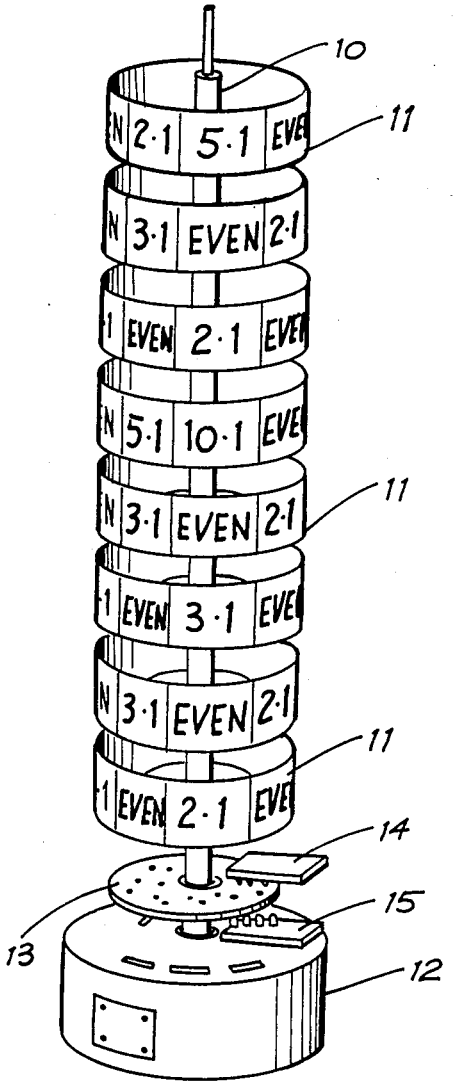
FIG. 1 is a view in elevation of an odds indicator according to the invention.

On each drum is displayed a series of ratios selected from the range of 1:1 (evens) to 10:1. The front column of ratios as seen in FIG. 1 is visible through a suitably shaped viewing window arranged in the front of a poker machine. The remainder of the apparatus is concealed within the body of the machine.

While it is convenient to use a plurality of separate drums the ratios may be displayed in axially distributed bands on the external surface of a single cylinder.

Near the bottom of the shaft 10 is a disc 13 having a plurality of holes formed in it, there being arranged on either side of the disc one or more sources of light indicated generally at 14 and one or more photocells indicated generally at 15. These are for ascertaining the rotational position of the shaft 10 and for controlling it's rotation in the manner described below.

On the front of the machine is a panel such as that shown in FIG. 2 in which the centre of the figure represents what is seen through the viewing window 16.

At the top of the panel are shown prizes to be won for combinations of five symbols, the panel being constructed for a five reel machine, thus five aces gives rise to a prize of 5,000 units whereas five sevens gives rise to a prize of 500 units. In this particular arrangement, prizes for these particular combinations are invariable and unaffected by the ratios displayed on the odds indicator.

On either side of the viewing window 16 a table is displayed showing prize winning combinations and the odds associated with them. In the extreme left and right hand columns are displayed a number of possible combinations for example, four jokers, four aces etc., and in the body of the table is exhibited the prize that is won by a particular combination depending on the ratio appearing in the odds indicator window. For example, for a combination of four jokers, if the 1:1 (evens) ratio is displayed the prize is 1,000 units. If however the 10:1 ratio is displayed the prize is 10,000 units.

At the bottom of the table are displayed minor prizes for example, a single nine on the left hand reel gives rise to a prize of 2 units. These, like the larger prizes, are invariable.

The operation of the odds reel shown in FIG. 1 can be carried out in a wide variety of different ways. It could be spun and stopped at random. It is however preferred that it be controlled by a stepper motor controlled by a random number generator or by the length of time between handle pulls. It may however be controlled in any other manner. The odds reel can be free spinning, being operated by a mechanical kick mechanism. Controlled stopping of the odds reel assembly instead of random stopping may be preferred in which case a pre-programmed series of stop positions, which is possible with a stepper motor, would be contained in a microprocessor memory and could, if required be arranged to be changed from time to time as desired. Where a controlled stopping is employed it may be used to correct machine percentage variations, that is to say to adjust payouts on a random machine to reduce the difference between actual revenue and theoretical revenue at the end of a nominated period.

Whether the odds indicator is allowed to spin freely or controlled it's operation could be arranged to allow a more frequently occurring symbol such as jacks to become temporarily jackpot symbols.

The period after which rotation of the odds indicator occurs relative to a normal game, can be effected in many ways, two of which are:

(1) Rotation of the odds indicator is commenced when the handle of the machine is pulled and stopped when one or other of the reels, for example the last reel, stops rotating;

(2) The odds indicator can be stepped each time the handle is pulled to bring the next column of ratios behind the viewing window.

The disc 13 and the light sources 14 and photocells 15 are used to ascertain the stepper motor's position. This can be done in a variety of different ways. In one system a count is effected to ascertain the stopped position of the disc, either the number of pulses applied to the motor or alternatively the number of pulses coming back from a counting photocell are counted. Verification is needed for this system by a different pulse to indicate that the indexing position has passed, otherwise any interference with its position will result in a succession of incorrect readings. The indexed position can be detected by a separate photocell especially for this function, or alternatively the counting photocell can be used to give a different type of pulse for index compared with its pulse for all other positions. A system involving this arrangement is described in the specification of Australian patent application 31886/84.

Alternatively, a system may be used which does not count, using instead combinations of at least three photocells to give an individual code for each individual position. This is proof against cheats manipulating stationary reels, as its position after pulsing before pay out can be compared by a microprocessor. As in the first system if cheats were to hold the reels against rotation, unbroken light beams can signal the "game invalid" or "tilt" alarm.

As the technology relating to the operation and control of stepping motors in relation to reels for poker machines is well known it is not necessary to describe the systems in detail.

The embodiment of the invention described above is given by way of example only as constituting a preferred form of the invention within the scope thereof as hereinbefore broadly defined.

I claim:

1. An odds indicator for a poker machine consisting of a cylinder having on its external surface a plurality of axially distributed bands each band bearing on its circumference a plurality of circumferentially spaced indicia each indicating a ratio by which a prize offered for a prize winning combination is to be multiplied, one ratio of the ratios displayed on each band being visible through a viewing window in the front of the machine in a column one above the other or side by side, there being displayed on the front of the machine a list of prize winning combinations opposite each of which, or a number of which, one of the visible ratios appears and an indication of the prize to be delivered on achieving that particular combination when any of the ratios displayed on a band is visible, means being provided for rotation of the cylinder to enable the visible ratios to be changed.

2. An odds indicator as claimed in claim 1 wherein the cylinder is made up of a plurality of separate drums each carrying a single one of said bands.

3. An odds indicator for a poker machine as claimed in claim 1 wherein the said cylinder extends vertically and has at one end a stepper motor by means of which it is rotated and having means carried by the cylinder to provide an indication of the rotated position of the cylinder.

* * * * *